US008136274B2

(12) United States Patent
Sunder et al.

(10) Patent No.: US 8,136,274 B2
(45) Date of Patent: Mar. 20, 2012

(54) IRONING PAD COMPRISING LIQUID STAIN TREATMENT AGENT

(75) Inventors: Matthias Sunder, Düsseldorf (DE); Robert Stephen Cappleman, Duisburg (DE); Heike Schirmer-Ditze, Düsseldorf (DE); Matthias Uwe Blana, Kaarst (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 152 days.

(21) Appl. No.: 12/690,132

(22) Filed: Jan. 20, 2010

(65) Prior Publication Data

US 2010/0186268 A1 Jul. 29, 2010

Related U.S. Application Data

(63) Continuation of application No. PCT/EP2008/054960, filed on Apr. 24, 2008.

(30) Foreign Application Priority Data

Jul. 20, 2007 (DE) ..... 10 2007 034 541

(51) Int. Cl.
*D06F 65/00* (2006.01)
*A47L 25/08* (2006.01)
*A47L 25/00* (2006.01)

(52) U.S. Cl. ..... 38/144; 15/209.1; 68/228

(58) Field of Classification Search ..... 38/140, 38/144, 14, 66; 15/320, 208, 209.1, 210.1; 68/208, 209.1, 5 A, 228, 233
See application file for complete search history.

(56) References Cited

U.S. PATENT DOCUMENTS

| | | | | |
|---|---|---|---|---|
| 2,810,216 | A * | 10/1957 | Greer | 38/2 |
| 5,707,163 | A * | 1/1998 | Gregory | 401/10 |
| 6,048,368 | A * | 4/2000 | Tcheou et al. | 8/137 |
| 6,233,771 | B1 * | 5/2001 | Hortel et al. | 8/150 |
| 6,883,353 | B2 * | 4/2005 | Goldoni et al. | 68/5 A |
| 7,596,974 | B2 * | 10/2009 | Smith et al. | 68/213 |
| 7,610,647 | B2 * | 11/2009 | Morgan et al. | 15/104.94 |
| 2003/0087781 | A1 * | 5/2003 | Van Hauwermeiren et al. | 510/214 |

FOREIGN PATENT DOCUMENTS

| | | | |
|---|---|---|---|
| DE | 202006006880 | U1 | 8/2006 |
| EP | 0910619 | B1 | 4/1999 |
| FR | 1227461 | A | 8/1960 |
| FR | 2807933 | A | 10/2001 |
| GB | 2376472 | A | 12/2002 |
| GB | 2417903 | A | 3/2006 |

* cited by examiner

*Primary Examiner* — Ismael Izaguirre
(74) *Attorney, Agent, or Firm* — David P. LeCroy

(57) ABSTRACT

The invention relates to an ironing pad comprising a solid material (1) which reversibly absorbs liquid and a liquid stain treatment composition which is absorbed by the solid material (1) which reversibly absorbs liquid. The invention relates to a process for treating a stain on a textile fabric with such an ironing pad by placing the ironing pad onto the stain and exerting heat and/or pressure on the ironing pad.

13 Claims, 1 Drawing Sheet

IRONING PAD COMPRISING LIQUID STAIN TREATMENT AGENT

CROSS REFERENCE TO RELATED APPLICATIONS

The present application is a continuation of International Patent Application No. PCT/EP2008/054960 filed 24 Apr. 2008, which claim priority to German Patent Application No. 10 2007 034 541.2 filed 20 Jul. 2007.

The invention relates to an ironing pad comprising a solid material which reversibly absorbs liquid and a liquid stain treatment agent. A method of stain removal with such an ironing pad is also described.

When textiles are domestically cleaned, for example, in a washing machine, not all stains are always completely removed. This can be due, for example, to the type of stains or to the incorrect treatment of the stains. This is especially annoying for the consumer if the stains are discovered only after the textile has been dried and, in particular, only when it is ironed.

A multi-stage method for (post-)treatment of a stain on a textile is known from EP 0910619 B1, wherein a detergent composition is applied to the stain, an absorptive layer placed in the area of the stain, and pressure and heat applied to the stain by means of an iron or similar pressure and heat on the opposite side of the textile to the absorptive layer.

It would be more practical for a consumer, however, if he or she were given the option of being able to treat the stain directly, without first having to apply a stain treatment composition and an absorptive layer in the area of the stain.

An object of the present invention is therefore to provide an agent for simple and direct (post-)treatment of stains.

This object is achieved by an ironing pad comprising a solid material able to reversibly absorb liquid and a liquid stain treatment agent, wherein the agent is absorbed by the solid material able to reversibly absorb liquid.

Such an ironing pad has the advantage that the consumer can place it directly over the stained areas of the washed textile and remove the stain by the application of heat and/or pressure, by bringing the liquid stain treatment agent reversibly absorbed by the solid material into contact with the stain to be removed.

Preferably, the solid material which reversibly absorbs liquid is chosen from viscose, cellulose, cotton and combinations thereof.

In the conventional use of an ironing pad it comes into contact with a warm to hot soleplate of an iron. Therefore, the solid material which reversibly absorbs liquid should be made from heat-resistant material. Viscose, cellulose, cotton, and combinations thereof, in particular, combinations of viscose and cellulose, are particularly suitable for use as the solid material able to reversibly absorb liquid.

The temperature of the soleplate can be adjusted according to the fabric ironed by setting different levels on the iron. Most domestic irons have, for example, three setting levels. The solid material able to reversibly absorb liquid is preferably heat-resistant up to at least 110° C. (corresponding to the soleplate temperature for level 1), more preferably heat-resistant up to at least 150° C. (corresponding to the soleplate temperature for level 2) and most preferably heat-resistant up to at least 220° C. (corresponding to the soleplate temperature for level 3). In order for it to also withstand temperature peaks, it is most preferable that the solid material able to reversibly absorb liquid be heat-resistant to at least 250° C.

Within the context of this application, "heat-resistant" means that the solid material able to reversibly absorb liquid does not break down with disintegration of the structure/form of the material in contact with the hot soleplate, but rather at most only becomes discolored.

These materials are not only resistant to heat and pressure, but also have a certain absorption capacity so that part or all of the treated stain can be transferred to the solid material able to reversibly absorb liquid when treated with the ironing pad.

Preferably, the liquid stain treatment agent contains hydrogen peroxide or a source thereof.

Many of the stains which are not (completely) removed in a conventional domestic washing and cleaning process (e.g., in a washing machine) are bleachable stains. Stains can be made less visible with a stain treatment agent containing hydrogen peroxide. Furthermore, hydrogen peroxide can be incorporated particularly easily into a liquid stain treatment agent, is an inexpensive bleach, and leaves no residues on textiles treated therewith.

The liquid stain treatment agent preferably contains one or more ingredients chosen from surfactants, defoaming agents, complexing agents, preservatives, perfumes, organic solvents, pH adjusters, textile care compounds and mixtures thereof.

These ingredients can be advantageous in actual treatment of the stain. For example, they can impart a pleasant fragrance to the textile fabric treated with the ironing pad. As another example, the ingredients can also stabilize the stain treatment agent itself or impart a property pleasing to the consumer (e.g., a pleasant fragrance) to the stain treatment agent.

A particularly preferred further constituent of the stain treatment agent, by virtue of its interfacial-tension-reducing and hence stain-removal-supporting action, is a surfactant. The surfactant may be present in the stain treatment agent in an amount of from 0.01 to 10 wt. %, preferably from 0.1 to 5 wt. %, and most particularly preferably from 0.25 to 3 wt. %, based on total weight of the stain treatment agent.

Preferably, the solid material able to reversibly absorb liquid is sheet-like and has a first side and a second side.

This design of the solid material able to reversibly absorb liquid allows an optimal surface area of contact with the stain that is treated.

In a preferred embodiment of the invention, the first side of the solid material able to reversibly absorb liquid is at least partially covered with a moisture-impermeable substance.

In another preferred embodiment of the invention, the moisture-impermeable substance can be applied to at least part of the edge of the first side, or to at least part of the edges of the first and second sides of the solid material able to reversibly absorb liquid. In this embodiment, the moisture-impermeable substance can preferably extend from the first side of the solid material able to reversibly absorb liquid over the edge onto the second side of the solid material able to reversibly absorb liquid.

With application of a moisture-impermeable substance, the user of the ironing pad can grasp it, for example, when removing it from the packaging or when placing it on the stain to be treated without coming into direct contact with the liquid stain treatment agent.

Preferably the moisture-impermeable substance is aluminum, particularly, aluminum foil.

This material is heat-resistant and guarantees presence of the moisture-impermeable substance even after the ironing pad has been ironed over.

The invention also relates to a method for treatment of a stain on a textile fabric, comprising the following steps:

placing an ironing pad on the stained textile, wherein the ironing pad comprises a cover, a solid material able to reversibly absorb liquid and a liquid stain treatment agent, wherein the liquid stain treatment agent is absorbed by the solid material able to reversibly absorb liquid, applying heat and/or pressure to the ironing pad thereby releasing the liquid stain treatment agent from the solid material for treating the stain, whereby at least part of the stain is removed from the textile, and removing the ironing pad from the treated textile.

This method allows a stain to be removed quickly and easily from a textile which has already been washed and dried.

Preferably, the heat and/or pressure is applied with an iron.

When an ironing pad is ironed over, the liquid stain treatment agent is released by the weight of the iron and brought into contact with a stain to be removed. Together with the heat released by the iron, the stain is at least partially removed.

The invention is explained in more detail below by reference inter alia to the Figures and Examples.

Figure 1:
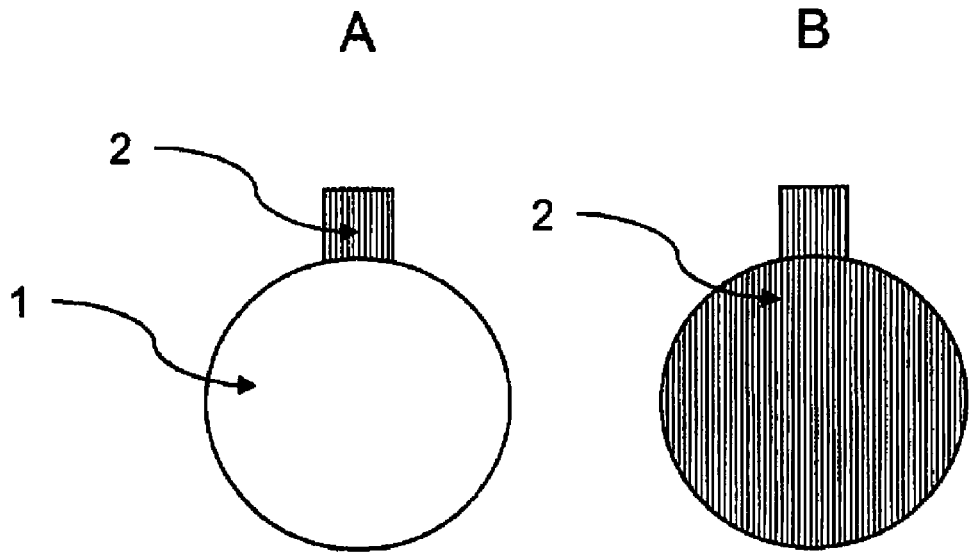
FIG. 1 illustrates a first embodiment of the invention wherein the first side of a solid material able to reversibly absorb liquid is completely covered with the moisture-impermeable substance.

The ironing pad comprises a solid material (1) able to reversibly absorb liquid and a liquid stain treatment agent, wherein the agent is absorbed by the solid material (1) able to reversibly absorb liquid.

The liquid stain treatment agent is a substantial component of the ironing pad and can contain from 0 to 25 wt. %, preferably from 0.01 to 10 wt. % and most preferably from 0.5 to 4 wt. % of bleach, based on total weight of the liquid stain treatment agent. The bleach is preferably a peroxide bleach, and most preferably hydrogen peroxide. Per-acids, per-salts or hypohalides such as hypochlorite can alternatively also be used as bleach in the liquid stain treatment agent.

The liquid stain treatment agent can further contain one or more surfactants. The surfactant is present in the stain treatment agent in an amount from 0.01 to 10 wt. %, preferably from 0.1 to 5 wt. %, and most particularly preferably from 0.25 to 3 wt. %, based on total weight of the liquid stain treatment agent. The stain treatment agent can contain anionic, non-ionic, zwitterionic and/or amphoteric surfactants.

Alkoxylated, advantageously ethoxylated, in particular, primary alcohols having preferably 8 to 18 C atoms and on average 1 to 12 mol of ethylene oxide (EO) per mol of alcohol are preferably used as non-ionic surfactants, wherein the alcohol residue can be linear or preferably methyl-branched in the 2-position or can contain linear and methyl-branched residues in the mixture, such as are conventionally present in oxoalcohol residues. However, alcohol ethoxylates having linear residues obtained from alcohols of native origin having 12 to 18 C atoms (e.g., from coconut, palm, tallow or oleyl alcohol) and on average 2 to 8 EO per mol of alcohol are particularly preferred. Preferred ethoxylated alcohols include, for example, $C_{12-14}$ alcohols having 3 EO, 4 EO or 7 EO, $C_{9-11}$ alcohol having 7 EO, $C_{13-15}$ alcohols having 3 EO, 5 EO, 7 EO or 8 EO, $C_{12-18}$ alcohols having 3 EO, 5 EO or 7 EO, and mixtures thereof, such as mixtures of $C_{12-14}$ alcohol having 3 EO and $C_{12-18}$ alcohol having 7 EO. The specified degrees of ethoxylation are statistical averages which for an individual product can be a whole number or a fraction. Preferred alcohol ethoxylates have a narrow homolog distribution (narrow range ethoxylates, NRE). In addition to these non-ionic surfactants, fatty alcohols having more than 12 EO can also be used. Examples thereof are tallow fatty alcohol having 14 EO, 25 EO, 30 EO or 40 EO. Non-ionic surfactants containing EO and PO groups together in the molecule can also be used according to the invention. Block copolymers having EO-PO block units or PO-EO block units can be used here, as too can EO-PO-EO copolymers or PO-EO-PO copolymers. Mixed alkoxylated non-ionic surfactants, in which EU and PO units are distributed randomly rather than in blocks, can also be used of course. Such products are obtainable by the simultaneous action of ethylene oxide and propylene oxide on fatty alcohols.

Alkyl glucosides of the general formula $RO(G)_x$ can also be used as non-ionic surfactants, wherein R represents a primary straight-chain or methyl-branched aliphatic residue, in particular, one methyl-branched in the 2-position, having 8 to 22, preferably 12 to 18 C atoms, and G represents a glycose unit having 5 or 6 C atoms, preferably glucose. The degree of oligomerization x, indicating the distribution of monoglycosides and oligoglycosides, is any number between 1 and 10, and is preferably between 1.2 and 1.4.

Another class of non-ionic surfactants preferably used, which can be used as the sole non-ionic surfactant or in combination with other non-ionic surfactants, are alkoxylated, preferably, ethoxylated or ethoxylated and propoxylated, fatty acid alkyl esters, preferably having 1 to 4 carbon atoms in the alkyl chain, in particular fatty acid methyl ester.

Non-ionic surfactants of the amine oxide type, for example, N-cocoalkyl-N,N-dimethyl amine oxide and N-tallow alkyl-N,N-dihydroxyethyl amine oxide, and of the fatty acid alkanol amide type can also be used. The amount of these non-ionic surfactants is preferably no more than that of the ethoxylated fatty alcohols, in particular no more than half that.

Other suitable surfactants include polyhydroxy fatty acid amides of the formula (I)—

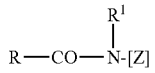

(I)

wherein R—CO represents an aliphatic acyl residue having 6 to 22 carbon atoms, $R^1$ represents hydrogen, an alkyl or hydroxyalkyl residue having 1 to 4 carbon atoms, and [Z] represents a linear or branched polyhydroxyalkyl residue having 3 to 10 carbon atoms and 3 to 10 hydroxyl groups. Polyhydroxy fatty acid amides are known substances obtainable by reductive amination of a reducing sugar with ammonia, an alkyl amine or an alkanol amine, and subsequent acylation with a fatty acid, a fatty acid alkyl ester or a fatty acid chloride.

Polyhydroxy fatty acid amides also include compounds of the formula (II)—

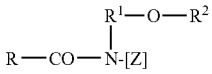

(II)

wherein R represents a linear or branched alkyl or alkenyl residue having 7 to 12 carbon atoms; $R^1$ represents a linear, branched or cyclic alkyl residue or an aryl residue having 2 to 8 carbon atoms; and $R^2$ represents a linear, branched or cyclic alkyl residue or an aryl residue or an oxyalkyl residue having 1 to 8 carbon atoms, with $C_{1-4}$ alkyl or phenyl residues being preferred; and [Z] represents a linear polyhydroxyalkyl residue whose alkyl chain is substituted with at least two hydroxyl groups, or alkoxylated, preferably ethoxylated or propoxylated derivatives of this residue.

[Z] is preferably obtained by reductive amination of a sugar (e.g., glucose, fructose, maltose, lactose, galactose, mannose or xylose). The N-alkoxy- or N-aryloxy-substituted compounds can then be converted into the desired polyhydroxy fatty acid amides by reaction with fatty acid methyl esters in the presence of an alkoxide as catalyst.

Alternatively or in addition to the non-ionic surfactants, the stain treatment agent can also contain anionic surfactants. Useful anionic surfactants include those of the sulfonate and sulfate type. Suitable sulfonate surfactants preferably include $C_{9-13}$ alkylbenzene sulfonates, olefin sulfonates (i.e., mixtures of alkene and hydroxyalkane sulfonates and disulfonates, such as are obtained from $C_{12-18}$ monoolefins having a terminal or internal double bond by sulfonation with gaseous sulfur trioxide and subsequent alkaline or acid hydrolysis of the sulfonation products). Also suitable are alkane sulfonates obtained from $C_{12-18}$ alkanes, for example, by sulfochlorination or sulfoxidation with subsequent hydrolysis or neutralization. Likewise, suitable anionic surfactants include esters of α-sulfo fatty acids (ester sulfonates), for example, α-sulfonated methyl esters of hydrogenated coconut, palm kernel or tallow fatty acids.

Other suitable anionic surfactants include sulfonated fatty acid glycerol esters. Fatty acid glycerol esters are understood to be the mono-, di- and triesters and mixtures thereof, such as are obtained by esterification of a monoglycerol having 1 to 3 mol of fatty acid or in interesterification of triglycerides having 0.3 to 2 mol of glycerol. Preferred sulfonated fatty acid glycerol esters include sulfonation products of saturated fatty acids having 6 to 22 carbon atoms, (e.g., hexanoic acid, octanoic acid, decanoic acid, myristic acid, lauric acid, palmitic acid, stearic acid or docosanoic acid).

Alkali, and in particular, sodium salts of the sulfuric acid semi-esters of $C_{12}$-$C_{18}$ fatty alcohols (e.g., coconut fatty alcohol, tallow fatty alcohol, lauryl, myristyl, cetyl or stearyl alcohol) or of $C_{10}$-$C_{20}$ oxoalcohols and the semi-esters of secondary alcohols having these chain lengths are preferred as alk(en)yl sulfates. Also preferred are alk(en)yl sulfates of the specified chain length containing a synthetic, straight-chain alkyl residue produced on a petrochemical basis, which have an analogous decomposition behavior to the appropriate compounds based on fat chemistry raw materials. Of interest from a detergent perspective are $C_{12}$-$C_{16}$ alkyl sulfates, $C_{12}$-$C_{15}$ alkyl sulfates and $C_{14}$-$C_{15}$ alkyl sulfates. 2,3-alkyl sulfates (commercially obtainable from the Shell Oil Company under the tradename DAN®) are also suitable anionic surfactants.

Sulfuric acid monoesters of the straight-chain or branched $C_{7-21}$ alcohols ethoxylated with 1 to 6 mol of ethylene oxide, such as 2-methyl-branched $C_{9-11}$ alcohols having on average 3.5 mol of ethylene oxide (EO) or $C_{12-18}$ fatty alcohols having 1 to 4 EO, are also suitable. In this respect, the stain treatment agent according to the invention may contain 0.01 to 5 wt. %, preferably 0.5 to 3 wt. % and in particular 1.5 to 2.5 wt. %, of an ethoxylated fatty alcohol sulfate based on total weight of the agent.

Other suitable anionic surfactants include salts of alkyl sulfosuccinic acid (also known as sulfosuccinates or sulfosuccinic acid esters) and monoesters and/or diesters of sulfosuccinic acid with alcohols, preferably fatty alcohols, and in particular ethoxylated fatty alcohols. Preferred sulfosuccinates contain $C_{8-18}$ fatty alcohol residues or mixtures thereof. Particularly preferred sulfosuccinates contain a fatty alcohol residue derived from ethoxylated fatty alcohols which are non-ionic surfactants in their own right (see below for a description). Once again, sulfosuccinates whose fatty alcohol residues derive from ethoxylated fatty alcohols having a narrow homolog distribution are particularly preferred. It is likewise possible to use alk(en)yl succinic acid having preferably 8 to 18 carbon atoms in the alk(en)yl chain or salts thereof.

Other suitable anionic surfactants include soaps. Saturated and unsaturated fatty acid soaps are suitable, such as the salts of lauric acid, myristic acid, palmitic acid, stearic acid, (hydrogenated) erucic acid and docosanoic acid, and in particular, soap mixtures derived from natural fatty acids (e.g., coconut, palm kernel, olive oil or tallow fatty acids).

Anionic surfactants, including soaps, can be present in the form of their sodium, potassium or magnesium salts. Anionic surfactants are preferably in the form of their sodium salts.

The liquid stain treatment agent preferably contains anionic surfactants, particularly alkyl sulfates and/or alkane sulfonates. Of these anionic surfactants, secondary alkane sulfonates, and most particularly secondary $C_{13-17}$ alkane sulfonates, are particularly preferred.

The liquid stain treatment agent can contain an organic solvent. The main solvent is preferably water, and the stain treatment agent optionally contains an organic solvent as an additional solvent. Suitable organic solvents include monovalent or polyvalent alcohols, alkanol amines or glycol ethers, provided that they are miscible with water in a concentration range from 1 to 45 wt. %, relative to the complete stain treatment agent. The solvents are preferably chosen from ethanol, n-propanol, i-propanol, butanols, glycol, 1,2-propanediol, 1,3-propanediol, butanediols, glycerol, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl ether, propylene glycol ethyl ether, propylene glycol propyl ether, dipropylene glycol monomethyl ether, dipropylene glycol monoethyl ether, methoxytriglycol, ethoxytriglycol, butoxytriglycol, diisopropylene glycol monomethyl ether, diisopropylene glycol monoethyl ether, 1-butoxyethoxy-2-propanol, 3-methyl-3-methoxybutanol, propylene glycol t-butyl ether, di-n-octyl ether, 1-(2-butoxypropoxy)propan-2-ol, toluene sulfonate, cumene sulfonate and mixtures of these solvents.

With surfactant-containing liquid stain treatment agents in particular, it can be advantageous for the agent to contain a defoaming agent. Examples of foam inhibitors useful in the liquid stain treatment agents include soaps, paraffins or silicone compounds, in particular silicone oils, which are optionally present as emulsions. The amount of foam inhibitor is preferably from 0.001 to 5 wt. %, and particularly preferably from 0.01 to 1 wt. %, based on total weight of the liquid stain treatment agent.

It can also be advantageous for the liquid stain treatment agent to contain a complexing agent. The complexing agent is chosen from those stable in the presence of bleach and which themselves stabilize the bleach by complexing metal ions. The amount of complexing agent is conventionally from 0.01 to 1 wt. %, based on total weight of the liquid stain treatment agent. Suitable complexing agents include alkali salts of ethylene diamine tetraacetic acid (EDTA), alkali salts of nitrilotriacetic acid (NTA), methylglycine diacetic acid trisodium salt (MGDA), iminodisuccinates (IDS) or ethylene diamine-N,N'-disuccinate (EDDS). Other suitable complexing agents include organophosphonates such as 1-hydroxyethane-1,1-diphosphonic acid (HEDP), aminotri(methylene phosphonic acid) (ATMP), diethylene triamine penta(methylene phosphonic acid) (DTPMP or DETPMP) and 2-phosphonobutane-1,2,4-tricarboxylic acid (PBS-AM), commonly used in the form of their ammonium or alkali metal salts.

The agent can include preservatives for stabilizing the liquid stain treatment agent against microorganisms. Examples of such preservatives include sorbic acid and its salts, benzoic acid and its salts, salicylic acid and its salts, phenoxyethanol, formic acid and its salts, 3-iodo-2-propynyl butyl carbamate, sodium N-(hydroxymethyl)glycinate, biphenyl-2-ol and mixtures thereof. Other suitable preservatives include isothiazolones, mixtures of isothiazolones and mixtures of isothiazolones with other compounds, for example, tetramethylol glycoluril.

The liquid stain removal agent can also include one or more perfumes in an amount of conventionally up to 15 wt. %, preferably 0.01 to 5 wt. %, in particular 0.3 to 3 wt. %, based on total weight of the liquid stain removal agent. Individual aroma compounds, for example, synthetic products of the ester, ether, aldehyde, ketone, alcohol and hydrocarbon type, can be used as perfume oils or fragrances. Mixtures of different aromas which together generate an attractive fragrance note are preferably used. Such perfume oils can also contain natural aroma mixtures accessible from plant sources.

The pH of the liquid stain treatment agent is adjusted so that it helps to stabilize the bleach, preferably hydrogen peroxide. Thus, pH is typically in the acid to weakly basic range and is from 3 to 8, preferably around 6.

A particularly preferred liquid stain treatment agent contains water, hydrogen peroxide and an anionic surfactant. An even more preferred stain treatment agent contains water, hydrogen peroxide, an anionic surfactant and a complexing agent.

To produce the ironing pad, the liquid stain treatment agent is applied to a solid material (1) able to reversibly absorb liquid. This material (1) is able to absorb the liquid stain treatment agent and to release it again under the application of pressure and/or heat.

Suitable solid materials (1) which reversibly absorb liquid include sponges, preferably in the form of open-cell foams. The solid material which reversibly absorbs liquid is particularly preferably cellulose, viscose, cotton or a mixture thereof. All of these materials have a high absorbency for liquids, are heat-resistant and are stable in respect of hydrogen peroxide. The solid material (1) which reversibly absorbs liquid is particularly preferably a sponge made from viscose and cellulose.

The solid material (1) able to reversibly absorb liquid should be heat-resistant to at least 110° C., more preferably to at least 150° C., even more preferably to at least 220° C. and most preferably to at least 250° C.

The amount of liquid textile treatment agent per $cm^2$ of solid material (1) depends on the absorbency of the material, but is preferably in the range from 0.1 to 0.5 $g/cm^2$, and more preferably in the range from 0.2 to 0.4 $g/cm^2$.

The solid material (1) is preferably sheet-like and has a first side and a second side. There is no restriction on the shape assumed by the solid material (1). From a production point of view, however, the shape is preferably round, square, triangular or rectangular.

To prevent the user from having to come into direct contact with the liquid textile treatment agent when placing the ironing pad on the stain to be treated, parts of the solid material which reversibly absorbs liquid are covered with a moisture-impermeable substance (2). The moisture-impermeable substance is heat-resistant and can include, for example, aluminum. The moisture-impermeable substance is particularly preferably aluminum foil.

In a first embodiment, the first side of the solid material (1) able to reversibly absorb liquid is at least partially covered with a moisture-impermeable substance (2). In a preferred embodiment the moisture-impermeable substance (2) covers the entire first side of the solid material (1). In a more preferred embodiment the moisture-impermeable substance (2) extends over the entire first side of the solid material (1) able to reversibly absorb liquid and partly beyond it, so that a type of tab is formed. Using this tab the user of the ironing pad can handle the pad easily and cleanly, for example, when removing the ironing pad from the packaging, placing it over the stain and/or disposing of it after use. FIG. 1 shows an embodiment of an ironing pad in wherein the moisture-impermeable substance (2) extends beyond the first side of the solid material (1) able to reversibly absorb liquid. FIG. 1A shows a view of the second side of the solid material (1), and FIG. 1B shows a view of the first side of the solid material (1), this being completely covered with the moisture-impermeable substance (2).

Figure 2:
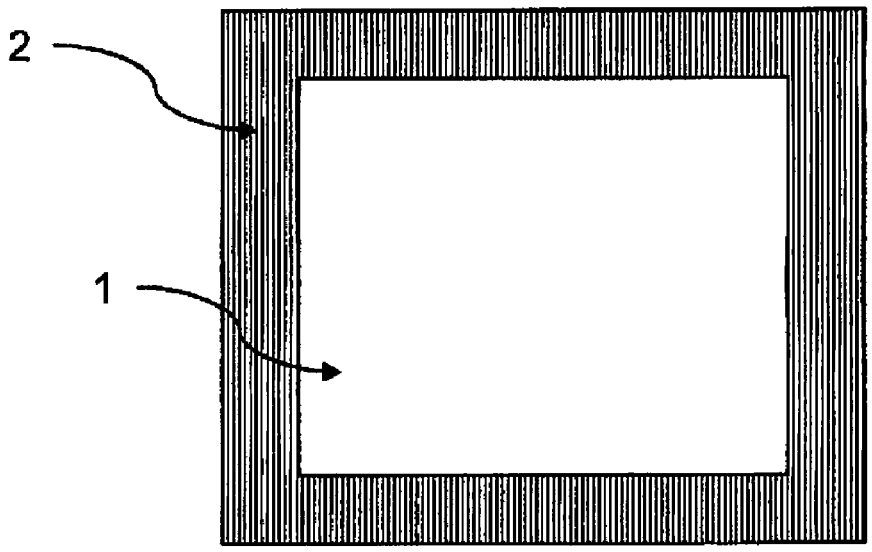
FIG. 2 illustrates a second embodiment of the invention wherein edges of the first side of the solid material able to reversibly absorb liquid are covered with the moisture-impermeable substance.

An alternative embodiment is shown in FIG. 2. In this embodiment the edges of the first side and second side of the solid material (1) are covered with the moisture-impermeable substance (2). The moisture-impermeable substance (2) extends in this embodiment from the first side of the solid material (1) over the edge and onto the second side of the solid material (1).

In a further embodiment of the ironing pad, the first side of the solid material (1) able to reversibly absorb liquid is designed as shown in FIG. 2; in other words, the edges are covered with the moisture-impermeable substance (2), and the cover extends over the edges/borders of the first side and completely over the second side of the solid material (1). This embodiment and the embodiment as shown in FIG. 1 are advantageous in that the warm to hot soleplate of the iron does not come directly into contact with the liquid stain treatment agent when the ironing pad is used.

The moisture-impermeable substance (2), and, in particular, the aluminum foil can be bonded to the solid material (1) by laminating, stitching or welding.

The application of the moisture-impermeable substance (2) can take place before and/or after absorption of the liquid stain treatment agent by the solid material (1). It is preferable for the moisture-impermeable substance (2) to be applied before absorption of the liquid stain treatment agent by the solid material (1).

In all embodiments it is preferable for the moisture-impermeable substance (2) to be applied contiguously.

The finished ironing pads are preferably stored in an airtight and steam-tight pack that allows the ironing pads to be removed individually. The pack can be, for example, a blister pack or a sealed film. In the latter case the ironing pad can be completely enclosed by the film and packed, for example, in a heat-sealed pouch, or in the embodiments in which one side of the ironing pad is completely covered with the moisture-impermeable substance (2) provided with a cover film and circumferential seal.

A blister pack is a pack which enables the user to see the packaged ironing pads. A blister pack can have a back board and a formed plastic element. The back board can comprise a plastic film or an aluminum foil. The back board and the formed plastic element can be joined by welding, clipping or stapling.

Heat-sealed pouches for storing the ironing pads are preferably made from a multi-layer composite material. The heat-sealed pouches preferably have one layer made from a support material, for example, polyethylene terephthalate (PET), a barrier layer, made from, for example, aluminum, and a layer with a sealing medium, for example, polyethylene (PE).

EXAMPLE

In order to produce an ironing pad the liquid stain treatment agent was prepared first. This was done by simply mixing together the ingredients listed in Table 1.

TABLE 1

| Composition of the liquid stain treatment agents (amounts in wt. %) | |
|---|---|
| Constituent | Formulation A |
| Secondary $C_{13-17}$ alkane sulfonate | 1.5 |
| HEDP | 0.1 |
| $H_2O_2$ | 2 |
| NaOH | 0.08 |
| Preservative, perfume | + |
| Water | to make 100 |

*HEDP: (1-Hydroxyethylidene) diphosphonic acid

A square sponge (dimensions: 50×50 mm) made from a cellulose/viscose blend (Polifix sponge cloth, Ecolab) was laminated with an aluminum foil covering the whole of the first side and all four edges of the second side. Then 0.28 g/cm$^2$ of Formulation A were applied to the sponge. The sponge completely absorbed the liquid stain treatment agent.

The ironing pad obtained was provided with an air-tight and steam-tight cover film and sealed.

In order to use the ironing pad, the cover film was removed and the ironing pad placed with the sponge side on the stain so that the stain can come into contact with the liquid stain treatment agent. By ironing over the ironing pad with a hot iron, the weight of the iron releases the liquid textile treatment agent, which, together with the temperature of the iron, removes or at least significantly reduces the treated stain.

Table 2 shows the results of the stain removal exercise. This exercise involved placing an ironing pad over stains which had been washed into cotton, and ironing over it with a domestic iron heated to level 2. The stains were each washed in by means of a washing cycle in a domestic washing machine (Miele Novotronic) at 40° C. A detergent containing no bleach and no enzymes was used.

The stain removal ability of the ironing pad E1 was determined by measuring the tristimulus value Y (DIN 5033). To this end the Y values of the stained, untreated textiles and the Y values of the stained textiles treated with an ironing pad were determined (see Table 2). The values were measured at 420 nm (instrument: Datacolor Spectraflash 600, 30 mm aperture).

TABLE 2

| Remission: Y value | | |
|---|---|---|
| Stain type | Stain before treatment | Stain after treatment with E1 |
| Blueberry juice | 55.2 | 81.5 |
| Grass | 78.0 | 83.0 |
| Spinach | 77.1 | 85.7 |
| Tomato ketchup | 83.2 | 86.4 |
| Cherry juice | 71.8 | 85.7 |
| Balsamic vinegar | 75.1 | 84.2 |
| Curry sauce | 78.0 | 84.5 |
| Chocolate spread | 52.6 | 69.7 |
| Spaghetti sauce | 82.5 | 85.7 |
| Red wine | 62.0 | 84.5 |
| Tea | 76.9 | 85.1 |
| Milk chocolate | 70.6 | 80.3 |
| Chocolate ice cream | 45.0 | 60.7 |
| Chocolate mousse | 68.1 | 79.1 |

From the data in Table 2 it is seen that stains in pre-washed textiles can be significantly reduced with the aid of an ironing pad E1 according to the invention.

Although the present invention has been described in detail, it is to be clearly understood that the same is by way of illustration and example only, and is not to be taken as a limitation. The spirit and scope of the present invention are to be limited only by the terms of any claims presented hereafter.

We claim:

1. Ironing pad comprising:

a solid material able to reversibly absorb liquid, and a liquid stain treatment agent, a wall extending from the first collar or second collar towards the interior of the bottle, wherein the agent is absorbed by the solid material able to reversibly absorb liquid, wherein the solid material is sheet-like and has a first side and a second side, and wherein the first side of the solid material is at least partially covered with a moisture-impermeable substance.

2. Ironing pad according to claim 1, wherein the solid material is heat-resistant to at least 110° C.

3. Ironing pad according to claim 1, wherein the solid material is chosen from viscose, cellulose, cotton and combinations thereof.

4. Ironing pad according to claim 1, wherein the liquid stain treatment agent comprises hydrogen peroxide or a source thereof.

5. Ironing pad according to claim 1, wherein the liquid stain treatment agent comprises one or more ingredients chosen from surfactants, defoaming agents, complexing agents, perfume, organic solvents, pH adjuster, textile care compounds and mixtures thereof.

6. Ironing pad according to claim 1, wherein the liquid stain treatment agent comprises a surfactant in a quantity of 0.01 to 10 wt. %, based on total weight of the agent.

7. Ironing pad according to claim 1, wherein the moisture-impermeable substance is applied to at least part of the edge of the first side or to at least part of the edges of the first and the second side of the solid material.

8. Ironing pad according to claim 7, wherein the moisture-impermeable substance extends from the first side of the solid material over the edge and onto the second side of the solid material.

9. Ironing pad according to claim 1, wherein the moisture-impermeable substance is at least aluminum.

10. Heat-sealed pouch comprising the ironing pad of claim 1.

11. Blister pack comprising a back board, a formed plastic element and the ironing pad of claim 1.

12. Method for treating a stain on a textile fabric, comprising:

placing an ironing pad on the stained textile, wherein the ironing pad comprises a cover, a solid material able to reversibly absorb liquid and a liquid stain treatment agent, wherein the liquid stain treatment agent is absorbed by the solid material able to reversibly absorb liquid, applying heat and/or pressure to the ironing pad thereby releasing the liquid stain treatment agent from the solid material for treating the stain, whereby at least part of the stain is removed from the textile, and removing the ironing pad from the treated textile fabric.

13. Method for treating a stain according to claim 12, wherein the heat and/or pressure are/is applied with an iron.

* * * * *